US006053753A

United States Patent [19]

Kunkle

[11] Patent Number: 6,053,753

[45] Date of Patent: Apr. 25, 2000

[54] SEALED ELECTRICAL CONNECTOR ASSEMBLY

[75] Inventor: John Philip Kunkle, Lancaster, Pa.

[73] Assignee: The Whitaker Corporation, Wilmington, Del.

[21] Appl. No.: 09/015,877

[22] Filed: Jan. 30, 1998

Related U.S. Application Data

[60] Provisional application No. 60/037,253, Jan. 31, 1997.

[51] Int. Cl.[7] ..... H01R 13/52

[52] U.S. Cl. ..... 439/275

[58] Field of Search ..... 439/595, 271, 439/274, 279, 587, 589, 275

[56] References Cited

U.S. PATENT DOCUMENTS

| | | | |
|---|---|---|---|
| 4,402,897 | 9/1983 | Cross et al. | 264/118 |
| 5,100,346 | 3/1992 | McCardell | 439/595 |
| 5,328,382 | 7/1994 | Pawlicki | 439/595 |
| 5,451,717 | 9/1995 | Itou | 174/77 R |
| 5,618,206 | 4/1997 | Sawada et al. | 439/587 |
| 5,823,811 | 10/1998 | Blanchfield et al. | 439/589 |
| 5,857,876 | 1/1999 | Hatagishi | 439/595 |

*Primary Examiner*—Michael L. Gellner
*Assistant Examiner*—Barry Standig

[57] ABSTRACT

A sealed electrical connector employs electrical contacts located in a housing with multiple contact receiving apertures, deflectable latches, and a seal section. A wire seal is mounted on the seal section, and a seal retainer is latched to the housing to retain the wire seal within the seal retainer and on the seal section. Wire seal sections are positioned within a seal retainer chamber with sufficient annular and radial clearance to permit deflection of the seal section due to transverse forces on the wires, without affecting the seal integrity around the wires. A lock plate is attachable to a housing mating face initially in a pre-staged position and shiftable to a locked position to prevent undesired deflection of the contact latch. The lock plate includes a tab forming an interference fit in a housing slot to hold the lock plate in either the pre-staged position or the locked position.

19 Claims, 4 Drawing Sheets

SEALED ELECTRICAL CONNECTOR ASSEMBLY

This application claims benefit of Provisional Application Ser. No. 60/037,253, filed Jan. 31, 1997.

BACKGROUND OF THE INVENTION

1. Field of the Invention

This invention is related to electrical connectors including electrical connectors that employ wire seals and auxiliary or secondary locking members to secure electrical contacts in a housing.

2. Description of the Prior Art

Electrical connectors, especially electrical connectors that are used in automotive applications, commonly employ wire seals, interface seals, and secondary or auxiliary locking members.

Locking members are typically terminal position assurance members that can be shifted between an initial position and a final position in which the locking member engages a housing latch to prevent deflection of the housing latch and displacement of one or more electrical contacts in the electrical connector housing. When the locking member is in the initial position, a terminal can be inserted through the rear of the connector housing. The housing latch is deflected to permit complete insertion of the electrical contact. When the electrical contact is fully inserted, the deflectable latch returns to its normal position. After the latch has returned to its normal position, the locking member can be shifted from its initial to its final position. If the electrical contact is not fully inserted, the latch cannot return to its normal position and the locking member cannot be shifted to its final position. A locking member functioning in this manner can be referred to as a terminal position assurance member.

Locking members of this type can be used on sealed and unsealed electrical connectors. Conventional sealed connectors include an interface seal located on or adjacent to a connector mating face. When the connector is mated with another connector, this interface seal establishes sealing integrity along the mating face. For connectors employing multiple electrical contacts, each attached to a wire, wire sealing means are employed. Typically the electrical contacts are inserted into the rear of the connector housing after the electrical contacts have been terminated to wires. For a conventional sealed connector, the terminals are inserted through wire seals mounted on the rear of the housing. After the terminals are inserted into housing cavities, the seals engage the exterior of each wire to establish sealing integrity around each wire. A single mat seal having multiple wire receiving apertures can be used. Other conventional connectors employ individual wire seals.

One common problem for sealed electrical connectors employing a secondary lock or a terminal position assurance member is that these connector assemblies employ multiple components and the individual components may perform multiple functions. Space then presents a problem because these connectors cannot be too large. The connectors must also perform reliably. For example, sealing integrity around the wires cannot be adversely affected by lateral movement of the wires. The locking members must also be sufficiently retained in both the initial and final positions.

SUMMARY OF THE INVENTION

The instant invention comprises an electrical connector that includes both sealing and secondary or auxiliary locking features.

The sealed electrical connector assembly employs multiple electrical contacts located in a housing. The housing includes multiple contact receiving apertures, each having a seal section. A wire seal is mounted on the seal section, and a seal retainer is latched to the housing to retain the wire seal on the seal section. The housing seal section is received within the wire seal and the wire seal is positioned within the seal retainer. The wire seal includes internal sealing surfaces for sealing around the wires and around the housing seal section. Wire seal sections are positioned within a seal retainer chamber with sufficient annular and radial clearance to permit deflection of the seal section due to transverse forces on the wires, without affecting the seal integrity around the wires.

The preferred embodiment of the electrical connector can also include deflectable contact latches projecting into the contact receiving apertures. A lock plate is attachable to a mating face of the housing initially in a pre-staged position and shiftable to a locked position to prevent undesired deflection of the contact latch. The lock plate includes a tab and the housing includes a slot, the width of the tab being greater than the width of the slot so that the tab can be wedged into the slot to hold the lock plate in either a pre-staged position or a locked position.

DETAILED DESCRIPTION OF THE INVENTION

Figure 1:
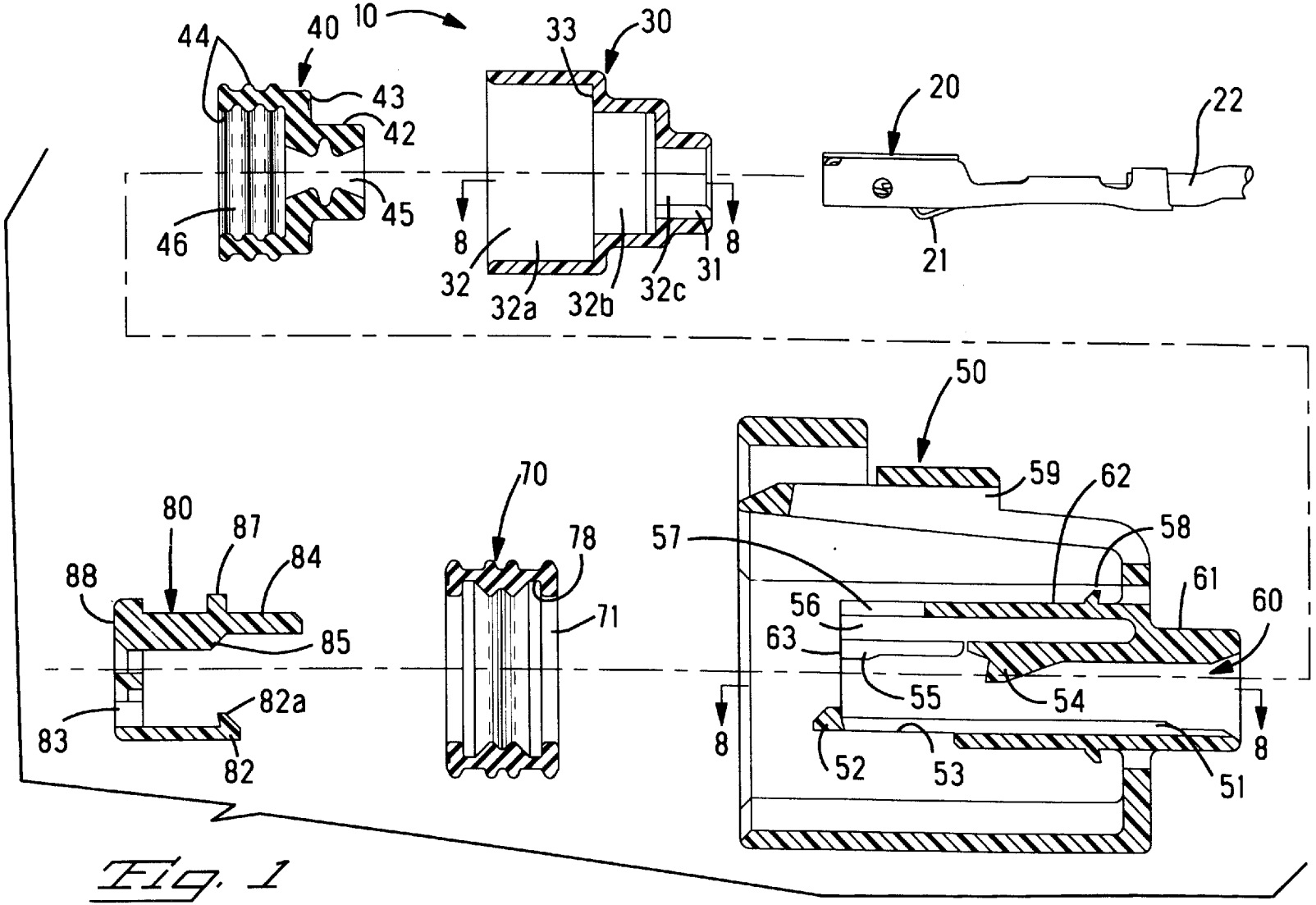
FIG. 1 is an exploded, cross sectional view of an electrical connector assembly according to the present invention.

Referring to FIGS. 1, 3–6, and 8–9 an electrical connector assembly 10 according to the present invention will be described. Electrical connector assembly 10 comprises a mateable connector comprising a plug housing 50. Plug housing 50 receives a wire seal 40 which is retained thereon by a wire seal retainer 30. An electrical contact 20 is inserted through wire seal 40, and a conductor 22 terminated with electrical contact 20 is sealingly engaged by wire seal 40. An interface seal 70 is disposed around a mating face area 63 of plug housing 50 for sealing engagement with a further electrical connector (not shown). A lock plate 80 is mounted to the mating face of plug housing 50 for providing a secondary lock with respect to contact 20. Electrical connector 10, therefore, provides a sealed connector assembly with secondary locking of electrical contacts 20.

Figure 8:
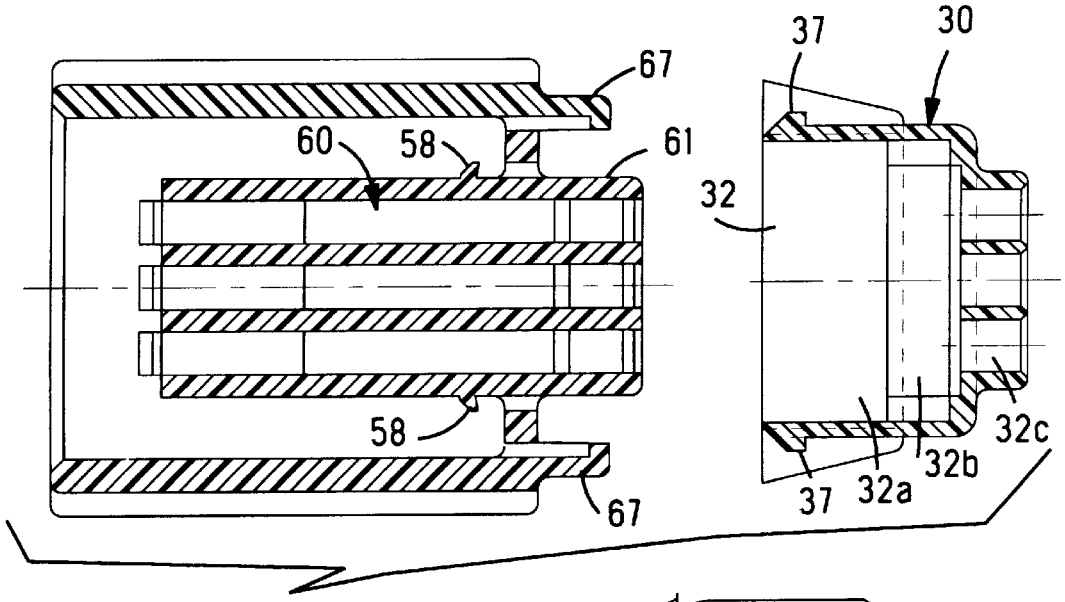
FIG. 8 shows a top, partial cross sectional view of the plug housing and seal retainer of FIG. 1 taken along lines 8—8.
Figure 9:
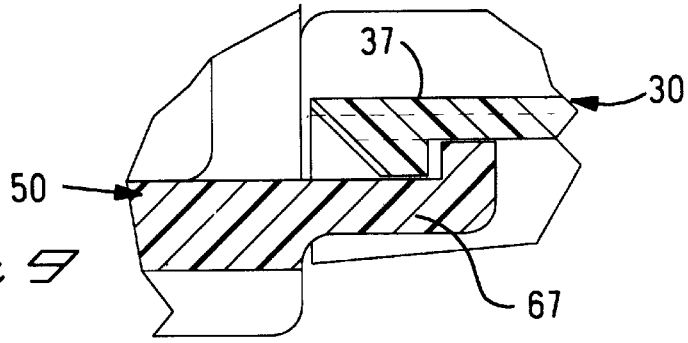
FIG. 9 shows a cross sectional detail view of the latching of the seal retainer to the plug housing of FIG. 8.

Electrical contact 20 is preferably of the receptacle type and comprises an orientation feature 21 on a bottom area thereof. Wire seal retainer 30 is preferably formed of a suitable plastic material and includes a cavity 32 which extends therethrough. Cavity 32 comprises chambers 32*a*, 32*b*, and 32*c*. Chamber 32*c* comprises an orientation slot 31. A sealing and retention surface 33 is formed between chambers 32*b* and 32*a*. As shown in FIGS. 8–9, retainer 30 also includes retainer latches 37.

Wire seal 40 is formed of a suitable resilient sealing material and comprises a wire seal section 42 with a plurality of undulated apertures 45 (only one aperture 45 is shown), and wire seal 40 includes a plug receiving cavity 46 formed therein. The outer surface of wire seal 40 comprises a sealing and retention ledge 43. Sealing undulations 44 are formed internally and externally of plug receiving cavity 46.

Plug housing 50 preferably includes a plurality of contact receiving apertures 60 for receiving respective contacts 20. Aperture 60 has an orientation groove 51 extending into seal section 61, and a deflectable contact latch 54 projecting therein. The mating face area 63 of aperture 60 comprises a latch member 52, a latch member opening 53, a groove 56, and a slot 57. A connector latch 59 is formed integrally with plug housing 50 for latching engagement with a further electrical connector (not shown). As shown in FIGS. 8–9, plug housing 50 also includes a set of lugs 67. Interface seal retaining projections 58 are formed laterally of aperture 60 on interface seal receiving area 62. Interface seal 70 is preferably formed of a resilient sealing material and comprises a plug housing receiving cavity 71 with a projection receiving area 78.

Figure 2:
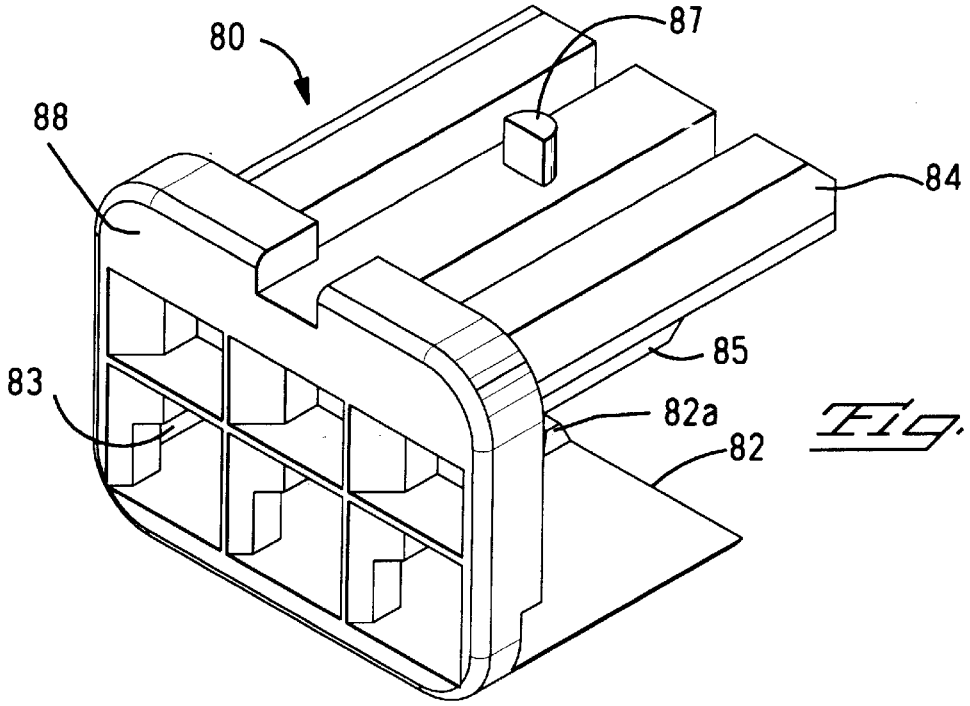
FIG. 2 is an isometric view of the lock plate of FIG. 1.

Referring to FIGS. 1–2, lock plate 80 comprises a deflectable lock member 82 with a lock projection 82*a* formed thereon. A mating face 88 includes a plurality of contact receiving apertures 83 therethrough. A plurality of lock beams 84 with integral alignment members 85 extend away from mating face 88. Preferably, the central lock beam 84 includes a tab 87 formed integrally therewith.

Figure 3:
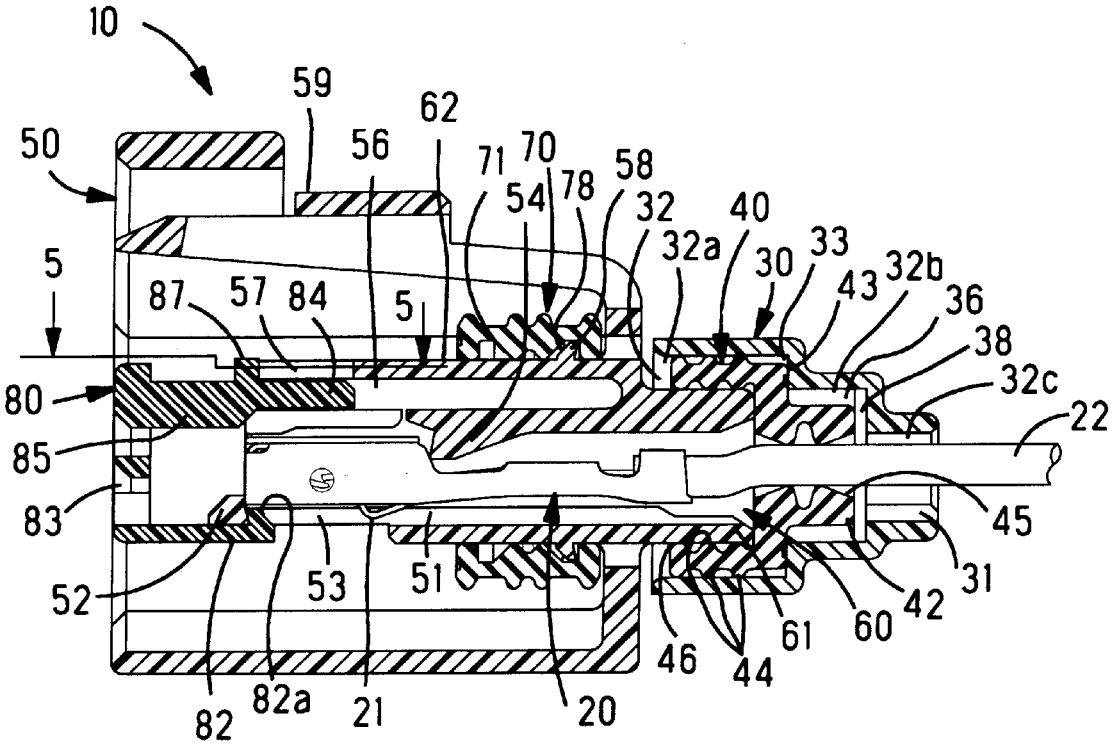
FIG. 3 is a cross sectional view of the electrical connector assembly of FIG. 1 when in an assembled state with the lock plate of FIG. 2 in a pre-staged position.

With reference to FIGS. 1–3, assembly of electrical connector assembly 10 will now be described. First, wire seal 40 is assembled to plug housing 50 so that seal section 61 is received in plug receiving cavity 46. Wire seal retainer 30 is then pushed over wire seal 40 so that undulated sections 44 are sealingly pressed against seal section 61 and against the walls of chamber 32*a*. Additionally, ledge 43 can be sealingly pressed by surface 33, and this radial interface also serves to retain the seal in place. Wire seal section 42 extends into chamber 32*b*; however, annular and radial clearances 36,38 remain between wire seal section 42 and wire seal retainer 30 within chamber 32*b*. At this point, retainer 30 is securely latched to plug housing 50 by retainer latches 37 engaging respective lugs 67 (FIG. 9). Next, interface seal 70 is placed over mating face 63 of plug housing 50 and is moved into place at seal receiving area 62 so that retaining projections 58 become lodged in projection receiving area 78. Lock plate 80 is then aligned with mating face 63 and is moved to a pre-staged position whereby, as shown in FIG. 3, lock projection 82*a* of lock member 82 is engaged with latch member 52 in latch member opening 53. At the pre-staged position shown in FIG. 5, tab 87 is slightly wedged in slot 57 because the width of tab 87 is relatively greater than the width of slot 57. Thus lock plate 80 is secured in the pre-staged position by the wedging of tab 87 in slot 57, and by lock projection 82*a* engaging latch member 52. Next, electrical contact 20 is inserted into contact receiving aperture 60 so that orientation feature 21 passes through orientation slot 31 and orientation groove 51, thereby assuring proper orientation of contact 20 with respect to plug housing 50. However, as contact 20 passes through aperture 45 of wire seal 40, wire seal section 42 bulges outwardly to partially fill annular clearance 36. As shown in FIG. 3, there is still an annular clearance 36 around wire seal section 42 as it seals around wire 22. As contact 20 is inserted into contact receiving aperture 60, contact latch 54 will deflect and then latch against contact 20, thereby securing contact 20 in plug housing 50.

Figure 4:
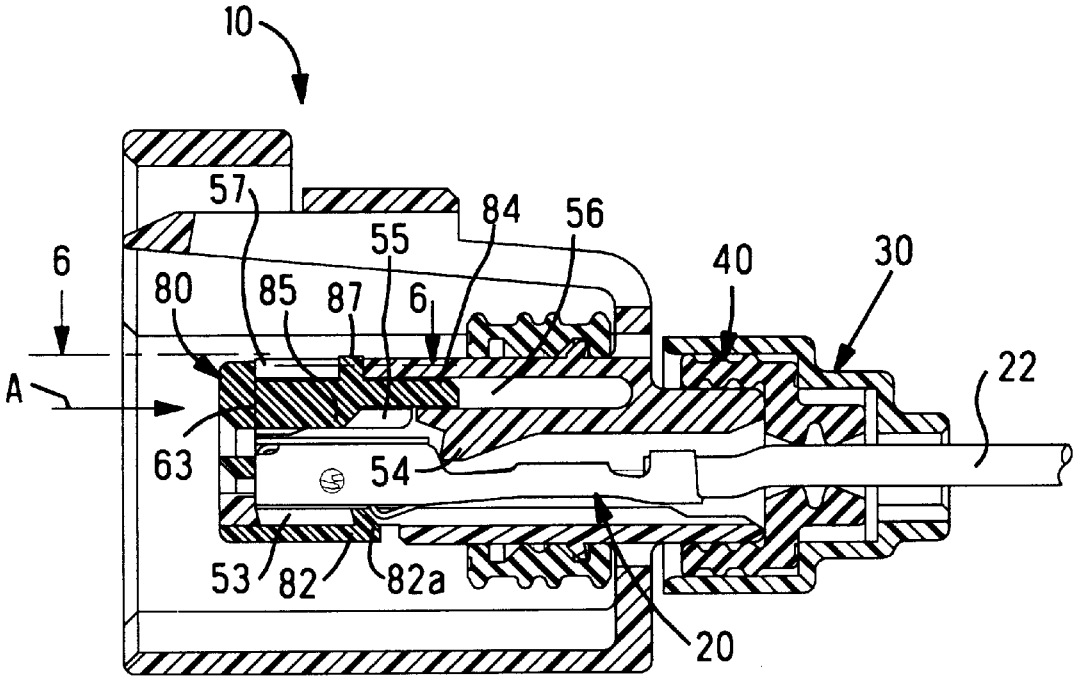
FIG. 4 is a cross sectional view of the electrical connector assembly of FIG. 1 when in a fully assembled state with the lock plate of FIG. 2 in a locked position.
Figure 5:
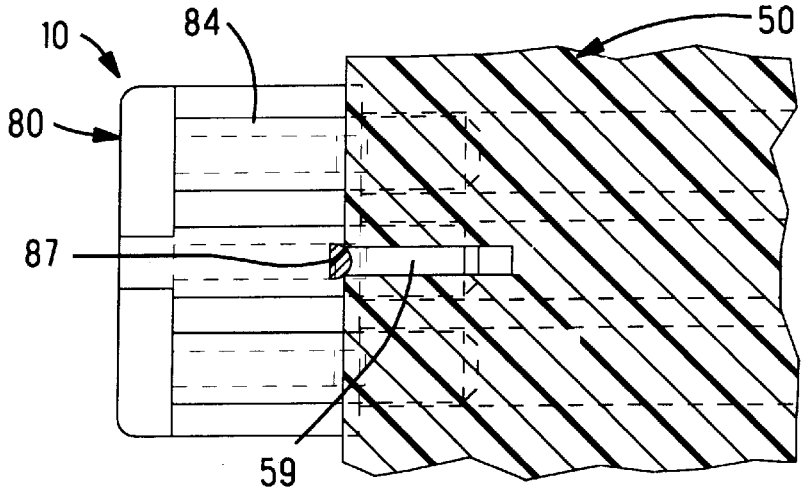
FIG. 5 is a top view in partial cross section of the pre-staged position taken along line 5—5 of FIG. 3.
Figure 6:
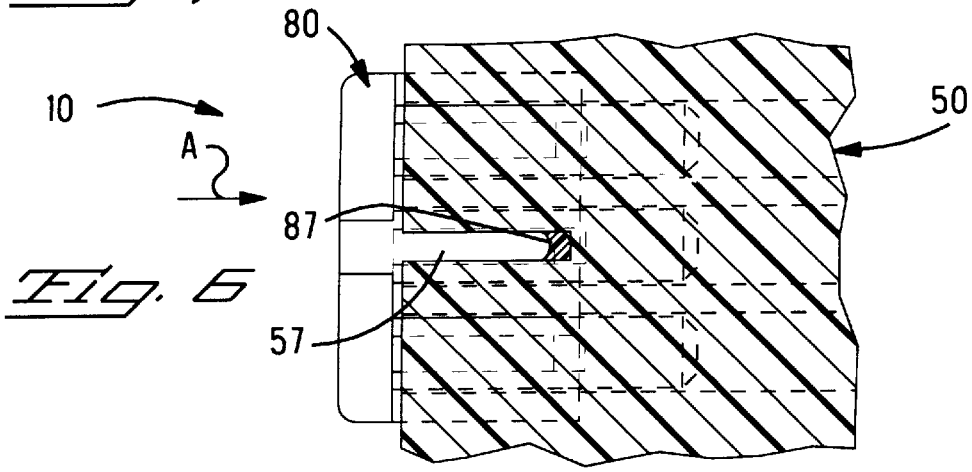
FIG. 6 is a top view in partial cross section of the locked position taken along line 6—6 of FIG. 4.
Figure 7:
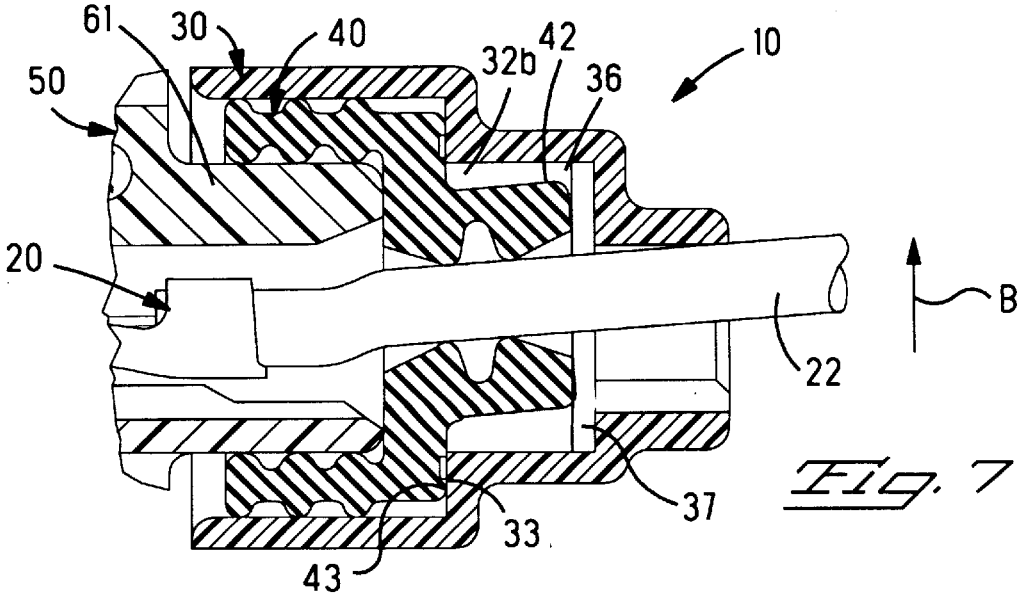
FIG. 7 is a side view of the wire sealing area of the electrical connector assembly according to the present invention.

As shown in FIGS. 4 and 6, when lock plate 80 is pushed toward contact 20 in the direction of arrow A, lock beam 84 and alignment member 85 are, respectively, pushed home into recess 56 and groove 55. Additionally, lock projection 82*a* slides in latch member opening 53 until tab 87 is fully inserted into and wedged in slot 57, as best shown in FIG. 6. As tab 87 is pressed along slot 57, material is sheared from the sides of tab 87 by the sides of slot 57, resulting in a sliding interference fit between tab 87 and slot 57, which assures a very firm lodging of tab 87 in slot 57. When lock plate 80 is fully advanced into a locked position with respect to plug housing 50, lock beam 84 is in place in recess 56 adjacent to contact latch 54. Lock beam 84 will prevent undesired deflection of contact latch 54 from, for example, pulling forces acting on wire 22. Secondary locking is thus provided to contact latch 54.

Where a transversely directed force moves wire 22 in the direction of arrow B of FIG. 7, for example, wire seal section 42 will be able to move into clearances 36 and 38, thereby allowing the material of wire seal 40 to flow under stress but to still maintain sealing engagement with wire 22. Moreover, surface 33 will maintain sealing pressure on ledge 43, and undulated sections 44 will seal against wire seal retainer 30 and seal receiving area 61.

In light of the foregoing, electrical connector 10 of the present invention provides substantial advantages. Namely, as contact 20 passes through aperture 45 of wire seal 40, clearance 36 allows wire seal section 42 to bulge outwardly, which prevents tearing of wire seal 40. Additionally, there is an annular clearance 36 around wire seal section 42 as it seals around wire 22. Where a transversely directed force moves wire 22 in the direction of arrow B of FIG. 7, for example, wire seal section 42 will be able to move into clearances 36 and 38, thereby allowing the material of wire seal 40 to flow under stress but to advantageously maintain sealing engagement with wire 22. The portion of the seal retainer containing aperture section 32*c* also restricts the extent to which a wire may be bent, thus limiting the deflection of the seal.

Moreover, lock projection 82*a* slides in latch member opening 53 until tab 87 is fully inserted into and wedged in slot 57, as best shown in FIG. 6. As tab 87 is pressed along slot 57, material is sheared from the sides of tab 87 by the sides of slot 57, resulting in a sliding interference fit between tab 87 and slot 57, which assures a very firm lodging of tab 87 in slot 57. When lock plate 80 is fully advanced into a locked position with respect to plug housing 50, lock beam 84 is in place in recess 56 adjacent to contact latch 54. Lock beam 84 will prevent undesired deflection of contact latch 54 from, for example, pulling forces acting on wire 22.

What is claimed is:

1. A sealed electrical connector assembly comprising:

at least one electrical contact located in a housing, the housing including at least one contact receiving aperture having a seal section;

a wire seal, mounted on the seal section and a seal retainer latched to the housing to retain the wire seal on the seal section, the sealed electrical connector assembly being characterized in that:

the housing seal section is received within the wire seal with a portion of the wire seal surrounding the housing seal section and the wire seal is positioned within the seal retainer with the seal retainer surrounding the wire seal and the portion of the housing seal section surrounded by the wire seal, the wire seal including first internal sealing surfaces for sealing around at least one wire and second internal sealing surfaces for sealing around the housing seal section.

2. The sealed electrical connector assembly of claim 1 wherein the wire seal includes a first seal surface and a second seal surface for sealing between the wire seal and the seal retainer.

3. The sealed electrical connector assembly of claim 2 wherein the second seal surface comprises a radially extending ledge.

4. The sealed electrical connector assembly of claim 1 wherein the wire seal includes at least one wire seal section positioned within a seal retainer chamber, with annular clearance between the wire seal section and the seal retainer chamber to permit the seal section to move into clearance when the wire is subjected to a transverse force while maintaining sealing integrity with the wire.

5. The sealed electrical connector assembly of claim 1 wherein the seal retainer includes three chambers, and external sealing surfaces or wire seal being located in the first front chamber, a wire seal section with internal seal surfaces engaging the wire being located in the second central chamber, and the wire extending through the third rear chamber.

6. The sealed electrical connector assembly of claim 5 wherein the first chamber is larger than the second chamber, and the second chamber is in turn larger than the third chamber.

7. The sealed electrical connector assembly of claim 5 wherein a radially extending surface is located between the first chamber and the second chamber with the wire seal including a sealing ledge engaging the radially extending surface.

8. The sealed electrical connector assembly of claim 7 wherein the wire seal also includes an external seal surface sealingly engaging the first chamber along an annular interior surface.

9. The sealed electrical connector assembly of claim 5 wherein the electrical contact includes a protruding orientation feature and the third chamber of the seal retainer includes an orientation slot for receiving the contact orientation feature.

10. The sealed electrical connector assembly of claim 1 wherein the housing includes multiple apertures and the wire seal includes multiple wire seal sections.

11. The sealed electrical connector assembly of claim 1 further including a lock plate securing a housing contact latch in position to retain an electrical contact in the housing.

12. The sealed electrical connector assembly of claim 11 wherein the lock plate includes multiple lock beams, each securing a separate contact latch in position to retain an electrical contact in the housing.

13. The sealed electrical connector assembly of claim 11 wherein the lock plate includes a tab received within a slot on the housing, sides of the tab being sheared as the tab is inserted into the slot to establish an interference fit holding the lock member in a locked position.

14. An electrical connector assembly comprising:

at least one electrical contact located in a housing, the housing including at least one contact receiving aperture with a deflectable contact latch projecting into the contact receiving aperture;

a lock plate attachable to a mating face of the housing initially in a pre-staged position and shiftable to a locked position to prevent undesired deflection of the contact latch;

the electrical connector being characterized in that;

the lock plate includes a tab and the housing includes a slot, the width of the tab being greater than the width of the slot so that the tab can be wedged into the slot to hold the lock plate in either the pre-staged position or the locked position, wherein sides of the tab are sheared as the tab is inserted through the slot into the locked position resulting in a sliding interference fit between the tab and the slot to firmly lodge the tab in the slot.

15. The electrical connector assembly of claim 14 wherein the housing comprises a plug housing including an interface seal and a wire seal on the plug housing.

16. The electrical connector assembly of claim 14 wherein the lock plate also includes a lock projection engaging a housing latch member to prevent removal of the lock plate from the housing.

17. The electrical connector assembly of claim 16 wherein the tab is located on the top of the lock plate and the lock projection is located on the bottom of the lock plate.

18. The electrical connector assembly of claim 17 wherein the lock projection is shiftable within an opening on the housing.

19. The electrical connector assembly of claim 18 wherein the opening extends along the bottom of the housing at the mating face and the slot extends along the top of the housing at the mating face, the opening being parallel to the slot.

* * * * *